United States Patent [19]

Maher

[11] 4,425,378

[45] Jan. 10, 1984

[54] ELECTROLESS NICKEL PLATING ACTIVATOR COMPOSITION A METHOD FOR USING AND A CERAMIC CAPACITOR MADE THEREWITH

[75] Inventor: John P. Maher, Adams, Mass.

[73] Assignee: Sprague Electric Company, North Adams, Mass.

[21] Appl. No.: 280,044

[22] Filed: Jul. 6, 1981

[51] Int. Cl.[3] ..... C23C 3/02

[52] U.S. Cl. ..... 427/79; 106/1.11; 427/80; 427/305

[58] Field of Search ..... 252/574; 106/1.11; 427/79, 80, 305

[56] References Cited

U.S. PATENT DOCUMENTS

| | | | |
|---|---|---|---|
| 3,207,706 | 9/1965 | Hoffman | 252/514 |
| 3,681,261 | 8/1972 | Mason | 252/514 |
| 3,741,780 | 6/1973 | Hoffman | 252/514 |
| 4,150,995 | 4/1979 | Moritsu | 252/514 |
| 4,243,710 | 1/1981 | Magrini | 252/514 |

FOREIGN PATENT DOCUMENTS

| | | | |
|---|---|---|---|
| 54-60497 | 5/1979 | Japan | 252/514 |
| 54-157296 | 12/1979 | Japan | 252/514 |

*Primary Examiner*—John D. Smith

[57] ABSTRACT

An activator composition paste includes a homogeneous dispersion of a palladium and commensurate amounts of silicon and of zinc. A screen printed layer of this paste is applied to a ceramic capacitor body to form electrodes, terminations or both. The body is heated to 615° C. and subsequently electroless nickel plated providing excellent electrical and mechanical connection of the plated nickel to the ceramic.

9 Claims, 4 Drawing Figures

ELECTROLESS NICKEL PLATING ACTIVATOR COMPOSITION A METHOD FOR USING AND A CERAMIC CAPACITOR MADE THEREWITH

BACKGROUND OF THE INVENTION

This invention relates to an electroless nickel plating activator particularly for use on ceramic capacitor bodies as terminations, and more particularly to such an activator based upon palladium.

Ceramic or glass products to be electroless plated generally require a surface activation treatment prior to introduction into the plating bath. A typical activation consists of immersion into solutions of tin and palladium chlorides.

A serious limitation of this technique is that the plated films often have insufficient adhesion to the base material, necessitating additional steps such as etching, sandblasting, or the like, to roughen the surface and allow mechanical interlocking. Additionally, it is often desired to plate only part of an article, requiring masking from the roughening process, activator, or plating solution or all three. In the case of disc ceramic capacitors, a common practice is to plate the entire body, and then employ grinding to remove plating from the areas where it is unwanted.

It is an object of this invention to provide an activator for an electroless nickel plating on ceramic and glass bodies that bond well and make intimate electrical contact thereto.

It is a further object of this invention to provide an effective low cost method for selectively activating a ceramic capacitor body for a subsequent electroless nickel termination plating.

It is yet a further object of this invention to provide a low cost ceramic capacitor having electroless plated terminations making intimate electrical contact and strong physical contact with the ceramic body.

SUMMARY OF THE INVENTION

An electroless plating activator composition for sensitizing a ceramic body consists essentially of a homogenous combination of palladium, at least half as much silicon and a greater quantity of zinc than of silicon, all by weight. Best results are obtained when the silicon is less than about 36 times that of the palladium.

This composition may be deposited onto the surface of a ceramic body by any means, such as by vacuum deposition, sputtering, spraying, screen printing and brushing, that will provide a uniform layer wherein the Pd, Si and Zn are homogeneously dispersed.

A particularly useful form of the composition for spraying, screen printing or brushing is made by mixing organo-resinates of the expensive palladium with the silicon and zinc, the latter each preferably being in the form of powdered metal or powdered oxide or other oxidizable/oxidized form. The silicon and/or zinc may also each be introduced as an organo-resinate, having the advantages of ease of measuring and handling, convenience in storage and accounting, and providing easy dispersal of the metal in the activator composition. Whether in metal powder form or resinate form, it is preferred to include in the start activator composition an organic binder such as ethyl cellulose and an organic vehicle such as terpineol for adjusting the viscosity especially for screen printing. When a resinate component is used, the deposited layer of the activator composition is heated to from 500° to 750° C. to drive off the organic material leaving the palladium dispersed with the silicon and zinc, the latter being mostly oxides of silicon and zinc.

A small amount of the silicon will be withdrawn from the activator layer and introduced into the intergranular interstices of the ceramic body at the surface. This is thought to be a means by which the silicon is effective in improving the bond to the ceramic. The remaining silicon serves to bond the palladium particles to each other.

Electroless nickel plating on a ceramic substrate may be used in printed circuits on alumina substrates or as part of a barium titanate ceramic capacitor with nickel terminations. For such products, the activator of the present invention makes possible a simple, reliable and easily controlled method for making such products wherein the nickel layer is strongly bonded to the ceramic and is uniformly thick at about 40 micro inches or more as desired.

In a simple disc type capacitor the electroless plated nickel layers, and corresponding activator films, may serve as the capacitor electrodes as well as solderable terminations. In a monolithic ceramic capacitor having two groups of interdigitated buried electrodes, each of the electroless plated nickel layers may contact one group of the buried layers and serve as a solderable termination therefor.

DESCRIPTION OF THE PREFERRED EMBODIMENTS

EXAMPLE 1

Figure 1:
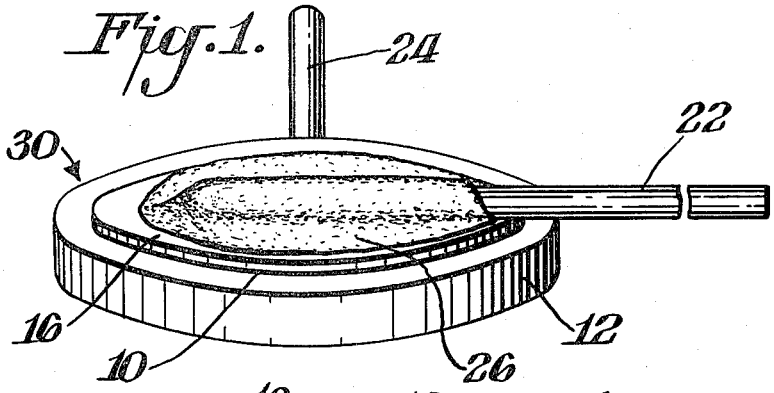
FIG. 1 shows in perspective view a ceramic disc capacitor that may be of this invention.

Four discoidal barium titanate bodies having a thickness of 0.02 inch (0.5 mm) were immersed in a solution of $SnCl_2$, then rinsed in water and transferred to a dilute solution of $PdCl_2$. They were rinsed again and placed in a conventional electroless nickel bath, namely product #792 supplied by Allied Kelite Products Division of the Richardson Company, Des Plaines, Ill. This plating bath was preheated to 90° C. The ceramic bodies were removed after 3 minutes at which time about 50 micro inches (1.3 microns) of nickel film had been formed over the entire surfaces of the ceramic bodies. The nickel film can be abraded or etched from the perimeters of the ceramic bodies to leave two separate electrodes, e.g. for forming a disc or wafer type capacitor.

Copper wires of 0.02 inch (0.5 mm) diameter were soldered orthogonally to one and the other major surfaces of the plated bodies. Electrical properties were good, but in a lead strength test whereby the two leads were pulled apart, the nickel film bond to the ceramic bodies failed at less than 1 pound.

EXAMPLE 2

Another group of four discoidal brain titanate bodies were first etched by immersion in fluoboric acid. After rinsing, these etched bodies had their surfaces activated in the tin and palladium solutions; they were electroless nickel plated; and they had leads attached all just as described for the capacitors of Example 1. The electrical properties were degraded, namely the dissipation factor increased an order of magnitude indicating damage to the ceramic caused by the etching. When subjected to the lead strength test, the average failure point was at 5 pounds (12.3 kg). Failure was largely within the ceramic surface.

EXAMPLE 3

An activator printing paste was prepared by first mixing 100 parts #318 terpineol and 4 parts of N-300 ethyl cellulose, both having been supplied by Hercules, Inc., Wilmington, Del. Then there was introduced in this paste 0.4 parts of 20% palladium resinate #7611 supplied by Engelhard Minerals and Chemicals, East Newark, N.J.

Figure 2:
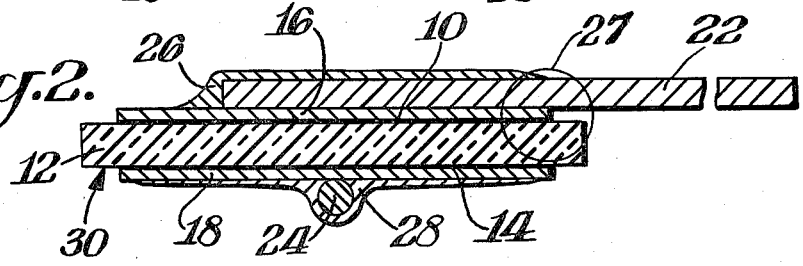
FIG. 2 shows in side sectional view the capacitor of FIG. 1.
Figure 3:
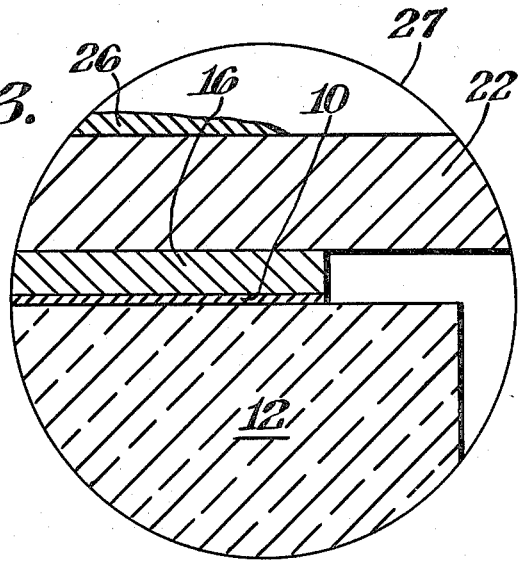
FIG. 3 shows in magnified detail a portion 27 of the capacitor of FIG. 2.

Referring to FIGS. 1, 2 and 3, a 35 micron thick coat (10) of this paste was screen printed onto one major surface of four 0.02 inch (0.5 mm) thick barium titanate discs such as disc 12. This screening step was repeated to deposit another paste coat (14) on the opposite major surface of discs (12). The coated discs (12) were then fired by raising the temperature in 10 minutes to a peak temperature of 615° C. and cooling thereafter at about the same rate. A faster heating cycle tends to cause a thermal shock induced cracking of the ceramic disc 12. After heating, the activator film is almost completely transparent. In related experiments it was determined that higher firing temperatures resulted in poorer plating. 750° C. is considered a practical maximum.

The ceramic discs were then immersed for about 3 minutes in the conventional electroless nickel plating solution of Examples 1 and 2. The bath was maintained at the elevated temperature of 90° C. The plating was excellent, i.e. the resulting nickel films 16 and 18 had an even thickness of about 50 micro inches (1.3 microns) and good contact with the capacitor dielectric disc was obtained as indicated by electrical measurements. The body was then rinsed in water and dried by heating at 120° C. for 15 minutes.

Copper wires 22 and 24 having a diameter of 0.02 inch (0.5 mm) were soldered at right angles to each other on the opposing nickel films 16 and 18, respectively. The resulting solder layers 26 and 28 are 60Sn40Pb. All material amounts in this example are given by weight.

In this way four capacitors 30 were made. By gripping the ends of leads 22 and 24 of each capacitor 30 and pulling with an increasing force, the force necessary to pull off either one or both of leads 22 and 24 was determined. In Example 3 this force was on average less than 1 pound, whereas it is desired to achieve a pull strength of at least $1\frac{1}{4}$ pounds, to avoid damage in subsequent capacitor lead bending or lead straightening operations as well as in capacitor encapsulation or capacitor assembly into printed wireboards or the like. These results are not substantially different than for those of Example 1. The only significant structural difference is that in the Example 3 capacitors the nickel plating was confined to the surface portions of the bodies that had been subjected to the screening of the activating paste and subsequent heating steps.

These results are summarized in the Table along with those of other examples. Examples 1 and 2 are omitted from the Table. No examples are included in the Table wherein the ceramic bodies have first been etched, but rather only changes in the electroless plating activator composition are presented for comparison here. The asterisks (*) indicate use of activators of this invention.

TABLE

| Ex. # | Pd (wt %) | Si (wt %) | ratio Si/Pd | Zn (wt %) | ratio Zn/Si | Plating Quality | Plating Adhesion |
|---|---|---|---|---|---|---|---|
| 3 | 0.08 | 0 | | 0 | | Excellent | 0.6 |
| 4 | 0.025 | 0 | | 0 | | Excellent | n.d. |
| 5 | 0.55 | 0 | | 0 | | Excellent | n.d. |
| 6 | 1.67 | 0 | | 0 | | Edges Ran | n.d. |
| 7 | 0.08 | 0.03 | 0.4 | 0 | | Fair-Poor | 0.6 |
| 8 | 0.16 | 0.06 | 0.4 | 0 | | Poor | 5.5 |
| 9 | 0.16 | 0.09 | 0.6 | 0 | | OK with $PdCl_2$ | 4.6 |
| 10 | 0.16 | 0.12 | 0.8 | 0 | | No Plate | |
| 11 | 0.04 | 0.06 | 1.5 | 0.04 | 0.7 | Poor-Fair | 4.7 |
| 12 | 0.04 | 0.06 | 1.5 | 0.06 | 1.0 | Fair | 4.9* |
| 13 | 0.04 | 0.06 | 1.5 | 0.08 | 1.3 | Excellent | 4.2* |
| 14 | 0.04 | 0.06 | 1.5 | 0.12 | 2.1 | Excellent | 5.9* |
| 15 | 0.04 | 0.18 | 4.5 | 0.08 | 0.4 | Poor-Fair | n.d. |
| 16 | 0.04 | 0.18 | 4.5 | 0.17 | 1.0 | Good | n.d. |
| 17 | 0.04 | 0.18 | 4.5 | 0.27 | 1.5 | Excellent | 3.1* |
| 18 | 0.04 | 0.18 | 4.5 | 0.35 | 1.9 | Excellent | 3.8* |
| 19 | 0.04 | 0.18 | 4.5 | 0.52 | 2.9 | Excellent | 1.4* |
| 20 | 0.08 | 0.18 | 2.3 | 0.27 | 1.5 | Excellent | 3.2* |
| 21 | 0.02 | 0.18 | 9.0 | 0.27 | 1.5 | Excellent | 3.2* |
| 22 | 0.01 | 0.18 | 18. | 0.27 | 1.5 | Excellent | 4.1* |
| 23 | 0.005 | 0.18 | 36. | 0.27 | 1.5 | Poor-Fair | 1.6 |
| 24 | 0 | 0.18 | | 0.27 | 1.5 | No Plate | |
| 25 | 0 | 0 | | 0.81 | | Excellent | 1.1 |
| 26 | 0.08 | 0 | | 0.18 | | Excellent | 1.7 |
| 27 | 0.34 | 0.73 | 2.1 | 1.08 | 1.5 | Excellent | 2.4* |
| 28 | 0.02 | 0.05 | 2.1 | 0.07 | 1.5 | Good | 2.1* |

For the examples listed in the Table, a 150 mesh screen with a 0.0005 inch (13 microns) emulsion was used for screen printing the experimental compositions. This produced a 35 micron thick wet film. If a deposition technique that produces a different thickness wet activator film is employed, the concentrations of Pd, Si and Zn must be adjusted so as to give the same weight per square area to achieve the same results as any one of these examples.

EXAMPLES 4–6

Ceramic disc capacitors were made in Examples 4, 5 and 6 by the same process as for those of Example 3 except that different amounts of the 20% palladium resinate were used as noted in the Table. The largest amount of palladium used, 350 micrograms per square centimeter in Example 6, provided good plating quality except that there was a tendency for the plating to spread into areas not coated with the sensitizer paste. It appears that diffusion follows the ceramic grain boundaries and a reduction in the activator firing temperature would likely minimize this unwanted spreading. However, cost considerations produce an overriding reason for keeping the palladium content lower.

EXAMPLES 7–10

The process of Example 3 was employed for making the capacitors of Examples 7 through 10, except that in addition to palladium there were added various amounts of silicon in the form of a silicon resinate. In Examples 9 and 10, plating could not be achieved at all until in the case of Example 9, th bodies were first dipped into the $PdCl_2$ solution after screening and firing the "activator" paste. It is believed that at heating, the silicon combines with oxygen in the ceramic forming silica ($SiO_2$) that diffused into the ceramic and possibly this silica diffusion is at a fixed rate regardless of the amount of silicon in the screened activator film (10). In this event, the ratio of silicon to palladium in the activator film (10) of the completed capacitors of Example 8 would be greater than for capacitors of Example 7 which may explain why the lead bonding in the latter is superior. In any event, from these examples it is clear that a silicon additive to the palladium activator is a spoiler of the plating quality. It is believed that the silicon remaining at the ceramic surface oxidizes and improves the bond between the palladium and the ceramic but when the ratio of silicon to palladium is too high, the silica masks the palladium to such an extent that it is not available to the nickel plating solution and is thus made less effective as an activator agent. Since organic components must be removed and bonding takes place via solid state diffusion, it is to be expected that firing temperatures below 500° C. would be inoperative. Capacitors fired at 400° C. in fact showed carbon residues and very low adhesion.

EXAMPLES 11–14

Yet a third ingredient, zinc, is added to the palladium and silicon containing activator pastes in Examples 11 through 14. The zinc is added as a zinc resinate. For all of these capacitors the adhesion of the nickel to the ceramic is greatly improved and for those of Examples 12–14 wherein the amount of zinc is at least equal to the amount of silicon (by weight), the plating quality ranges from fair to excellent. From this data of Examples 7–14, it is judged that the silicon to palladium ratio may be as low as about 0.4:1 if zinc were added to achieve strong good quality nickel terminations. Example 12 on the other hand shows that the zinc to silicon ratio may be as low as 1:1 to achieve satisfactory results.

EXAMPLES 15–19

Compared with capacitors of Examples 11 through 14, those of Examples 15 through 19 have a greater amount of silicon and again varying amounts of zinc while the amount of palladium remains the same. The zinc to silicon ratio again must be at least unity for good quality plating.

The composition of Example 17 was applied to an alumina body and electroless nickel plating applied by the same process. The results were essentially the same as for the barium titanate body.

A barium titanate dielectric body containing about 10% glass in an integranular phase was used as the body in a similar experiment. Only a medium plating quality resulted. A substantial amount of zinc was found to have left the activator layer and combined with the glass-ceramic body. A composition of 0.08 Pd, 0.18 Si and 0.43 zinc was then applied to the glass-ceramic and yielded excellent overall results.

Figure 4:
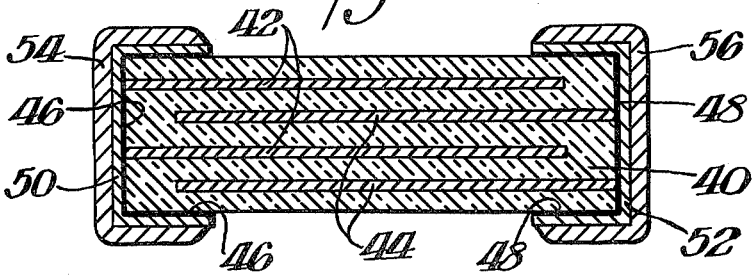
FIG. 4 shows in cross-sectional view a monolithic ceramic capacitor of this invention.

Also the activator and method of this invention are applicable to a monolithic ceramic capacitor as illustrated in FIG. 4, wherein a ceramic body 40 has two groups 42 and 44 of sheet electrodes interdigitated with each other and buried in the body 40. The left and right (as shown) surfaces of body 40 are coated with the activator films 46 and 48 that contact extended portions of electrodes 42 and 44, respectively. The electroless nickel plating layers 50 and 52 conform and adhere to activator films 46 and 48, respectively. Solder layers 54 and 56 likewise conform and adhere to nickel layers 50 and 52, respectively.

EXAMPLES 20–23

In the activator paste used for making these capacitors, the ratio of zinc to silicon was fixed at 1.5 and various amounts of palladium were used. It is concluded that the activator layer (10) must contain more than 0.005 weight percent palladium to achieve good plating quality in a 35 micron thick (wet) screened layer. This corresponds to 0.18 micrograms palladium per square centimeter.

EXAMPLES 24 AND 25

For both these examples there was no palladium. Ceramic bodies "activated" with the paste in Example 24 for which the zinc to silicon ratio is 1.5 could not be plated at all. However, in striking contrast the capacitors of Example 25 prepared with activator paste containing only zinc showed excellent plating quality but unsatisfactory lead strength. It appears that the zinc behaves itself somewhat like the activator agent, palladium. This is not fully understood. However, zinc is not by itself adequate for achieving both good plating and electrode adhesion.

EXAMPLE 26

Here there is no silicon and again as in Example 25, the plating quality is excellent but the adhesion is marginally satisfactory.

EXAMPLES 27 AND 28

The capacitors of Examples 27 and 28 as well as those of Example 20 have a silicon to palladium ratio of about 2 and a zinc to silicon ratio of about 1.5, while the absolute amounts of palladium that is incorporated in the activator layer (10) is, respectfully, 12, 0.8 and 3 micrograms per square centimeter. All produce satisfactory results even though the density of these elements in the activator paste cover a wide range. Excellent overall results are obtained for the lower amounts of silicon and zinc as in Example 22 wherein the palladium is as low as 0.35 micrograms per square centimeter, which is considered the low practical limit. Compared with the total cost of the capacitor, the cost of this tiny amount of palladium is insignificant.

In retrospect and with special attention to the results of Examples 8 and 11 through 14, it is clear that the amount of silicon may be reduced to around ½ that of the palladium provided appropriate amounts of zinc are used since the zinc additive has been shown itself to activate the plating to a limited degree as well as to counteract the spoiling properties which the silicon tends to have on plating quality. From Examples 11, 12 and 13 it is concluded that at least an equal amount of zinc as silicon is needed.

What is claimed is:

1. An electroless plating activator composition for sensitizing a ceramic surface to be electroless nickel plated consisting essentially of palladium, at least half as much silicon as palladium and 1.3 times as much zinc as silicon, all by weight, said palladium, silicon and zinc being homogeneously dispersed in a liquid organic vehicle.

2. The activator composition of claim 1 additionally comprising a liquid organic vehicle and an organic binder mixture in which said palladium, silicon and zinc are homogeneously dispersed.

3. The activator composition of claim 1 wherein said palladium is introduced in the form of a palladium resinate.

4. The activator composition of claim 1 wherein said silicon is introduced in the form of a silicon resinate.

5. The activator composition of claim 1 wherein said zinc is introduced in the form of a zinc resinate.

6. The activator composition of claim 1 wherein the silicon to palladium ratio by weight is less than 36.

7. A method for making a ceramic capacitor comprising (a) selectively depositing on a ceramic body two films of an electroless nickel activator composition consisting essentially of palladium, at least half as much by weight of silicon as of palladium and 1.3 times as much zinc as silicon by weight said palladium, silicon, and zinc being homogeneously dispersed in a liquid organic vehicle;

(b) heating said films to a peak temperature of from 500°-750° C.; and (c) electroless plating a layer of nickel over each of said films.

8. The method of claim 7 wherein said electroless nickel activator composition is combined in a liquid organic vehicle to form a paste, said depositing consisting of screen printing said paste, whereby said heating drives off said organic vehicle and more securely bonds said activator films to said substrate.

9. The activator composition of claim 1 wherein the ratio of said zinc to said silicon is no greater than 2.9.

* * * * *

UNITED STATES PATENT AND TRADEMARK OFFICE

CERTIFICATE OF CORRECTION

PATENT NO. : 4,425,378

DATED : January 10, 1984

INVENTOR(S) : John P. Maher

It is certified that error appears in the above-identified patent and that said Letters Patent is hereby corrected as shown below:

Column 2, line 65, "brain" should read -- barium --

Column 3, line 7, "(12.3 kg)" should read -- (2.3 kg) --

Column 4, under "Plating Adhesion" should appear -- (lbs) --

Column 5, line 23, "th" should read -- the --

Claim 3, line 1, "claim 1" should read -- claim 2 --

Claim 4, line 1, "claim 1" should read -- claim 2 --

Claim 5, line 1, "claim 1" should read -- claim 2 --

Signed and Sealed this

*Twenty-fifth* Day of *September 1984*

[SEAL]

*Attest:*

GERALD J. MOSSINGHOFF

*Attesting Officer*

*Commissioner of Patents and Trademarks*